US011296401B2

(12) United States Patent
Kim et al.

(10) Patent No.: US 11,296,401 B2
(45) Date of Patent: Apr. 5, 2022

(54) FILM ANTENNA AND DISPLAY DEVICE INCLUDING THE SAME

(71) Applicants: DONGWOO FINE-CHEM CO., LTD., Jeollabuk-do (KR); KREEMO INC., Seoul (KR)

(72) Inventors: Jong Min Kim, Gyeonggi-do (KR); Yun Seok Oh, Gyeonggi-do (KR); Yoon Ho Huh, Seoul (KR); Won Bin Hong, Seoul (KR)

(73) Assignees: DONGWOO FINE-CHEM CO., LTD., Jeollabuk-Do (KR); KREEMO INC., Seoul (KR)

( * ) Notice: Subject to any disclaimer, the term of this patent is extended or adjusted under 35 U.S.C. 154(b) by 0 days.

(21) Appl. No.: 16/860,836

(22) Filed: Apr. 28, 2020

(65) Prior Publication Data

US 2020/0259245 A1 Aug. 13, 2020

Related U.S. Application Data

(63) Continuation of application No. PCT/KR2018/013341, filed on Nov. 6, 2018.

(30) Foreign Application Priority Data

Nov. 6, 2017 (KR) ..... 10-2017-0146872

(51) Int. Cl.
*H01Q 1/24* (2006.01)
*H01Q 1/38* (2006.01)
(Continued)

(52) U.S. Cl.
CPC ..... *H01Q 1/243* (2013.01); *H01Q 1/38* (2013.01); *H01Q 1/44* (2013.01); *H01Q 9/0407* (2013.01)

(58) Field of Classification Search
CPC ..... H01Q 1/243; H01Q 1/38; H01Q 1/44; H01Q 9/0407; H01Q 21/08; H01Q 21/24; H01Q 21/28
See application file for complete search history.

(56) References Cited

U.S. PATENT DOCUMENTS 7,777,682 B2 * 8/2010 Yagi ..... H01Q 13/10 343/725
7,928,920 B2 * 4/2011 Yagi ..... H01Q 9/285 343/793
(Continued)

FOREIGN PATENT DOCUMENTS

CN 102918712 A 2/2013
CN 104681993 A 6/2015
(Continued)

OTHER PUBLICATIONS

International Search Report for PCT/KR2018/013341 dated Mar. 7, 2019.
(Continued)

*Primary Examiner* — Seung H Lee
(74) *Attorney, Agent, or Firm* — The PL Law Group, PLLC

(57) ABSTRACT

A film antenna according to an embodiment of the present invention includes a dielectric layer, and a vertical radiation pattern and a horizontal radiation pattern on an upper surface of the dielectric layer. The vertical radiation pattern and the horizontal radiation pattern are arranged together on the same plane. Multi-axis radiation properties may be implemented in the same film by the vertical radiation pattern and the horizontal radiation pattern.

17 Claims, 7 Drawing Sheets

(51) Int. Cl.
*H01Q 1/44* (2006.01)
*H01Q 9/04* (2006.01)

(56) References Cited

U.S. PATENT DOCUMENTS

| | | | | |
|---|---|---|---|---|
| 2015/0070228 | A1 | 3/2015 | Gu et al. | |
| 2019/0173182 | A1* | 6/2019 | Kim | H01Q 1/22 |

FOREIGN PATENT DOCUMENTS

| | | | |
|---|---|---|---|
| CN | 107078405 | A | 8/2017 |
| EP | 3 142 185 | A1 | 3/2017 |
| JP | 10-209749 | A | 8/1998 |
| JP | 2003-347822 | A | 12/2003 |
| JP | 2007-274528 | A | 10/2007 |
| JP | 2011-091557 | A | 5/2011 |
| JP | 2017-175540 | A | 9/2017 |
| KR | 10-2003-0095557 | A | 12/2003 |
| KR | 10-1744886 | B1 | 6/2017 |
| WO | WO 2012/164782 | A1 | 12/2012 |
| WO | WO 2016/063759 | A1 | 4/2016 |

OTHER PUBLICATIONS

Office action dated Jun. 1, 20121 from Japan Intellectual Property Office in a counterpart Japanese Patent Application No. 2020-543448 (all the cited references are listed in this IDS.) (English translation is also submitted herewith.).

* cited by examiner

FILM ANTENNA AND DISPLAY DEVICE INCLUDING THE SAME

CROSS REFERENCE TO RELATED APPLICATIONS AND CLAIM OF PRIORITY

The present application is a continuation application to International Application No. PCT/KR2018/013341 with an International Filing Date of Nov. 6, 2018, which claims the benefit of Korean Patent Application No. 10-2017-0146872 filed on Nov. 6, 2017 at the Korean Intellectual Property Office, the disclosures of which are incorporated by reference herein in their entirety.

BACKGROUND

1. Field

The present invention relates to a film antenna and a display device including the same. More particularly, the present invention related to a film antenna including an electrode and a dielectric layer and a display device including the same.

2. Description of the Related Art

As information technologies have been developed, a wireless communication technology such as Wi-Fi, Bluetooth, etc., is combined with a display device in, e.g., a smartphone form. In this case, an antenna may be combined with the display device to provide a communication function.

As mobile communication technologies have been rapidly developed, an antenna capable of operating a high-frequency or ultra-high frequency communication is needed in the display device. Further, as thin-layered display devices with high transparency and resolution such as a transparent display device, a flexible display device, etc., have been developed recently, the antenna having improved transparency and flexibility is also required.

For example, in a recent 5G high frequency band communication, as a wavelength becomes shorter, a signal transmission/reception may be easily blocked. Thus, a multi-axis signal transmission/reception may be advantageous to reduce a signal loss.

However, as the display device on which the antenna is mounted becomes thinner and lighter, a space for the antenna may also be reduced. Accordingly, an implementation of the multi-axis signal transmission/reception while improving signaling efficiency may not be achieved.

SUMMARY

According to an aspect of the present invention, there is provided an antenna device having improved gain and signaling efficiency.

According to an aspect of the present invention, there is provided a display device including a film antenna with improved gain and signaling efficiency.

The above aspects of the present invention will be achieved by one or more of the following features or constructions:

(1) A film antenna, may include: a dielectric layer having an upper surface and a lower surface opposite to the upper surface; a vertical radiation pattern on the upper surface of the dielectric layer; and a horizontal radiation pattern on the upper surface of the dielectric layer, the vertical radiation pattern and the horizontal radiation pattern being arranged on the same plane.

(2) The film antenna according to the above (1), wherein a distance between a center of the vertical radiation pattern and a center of the horizontal radiation pattern adjacent to each other may be $\lambda/2$ or more.

(3) The film antenna according to the above (1), wherein a length of the vertical radiation pattern may be $\lambda/2$ or more.

(4) The film antenna according to the above (1), wherein the horizontal radiation pattern may include a signal electrode and a ground electrode disposed on the same plane.

(5) The film antenna according to the above (4), wherein the ground electrode may include a pair of the ground electrodes, and a portion of the signal electrode may extend between the pair of the ground electrodes.

(6) The film antenna according to the above (4), wherein a length of the signal electrode may be $\lambda/4$ or more.

(7) The film antenna according to the above (1), wherein the vertical radiation pattern may include a plurality of the vertical radiation patterns, and the horizontal radiation pattern may include a plurality of the horizontal radiation patterns are arranged, and the plurality of the vertical radiation patterns may include a plurality of vertical radiation groups each formed by a predetermined number of the vertical radiation patterns, and the plurality of the horizontal radiation patterns may include a plurality of horizontal radiation groups each formed by a predetermined number of the horizontal radiation patterns.

(8) The film antenna according to the above (7), wherein the plurality of the vertical radiation groups may be successively arranged, and the plurality of the horizontal radiation groups may be successively arranged, while the plurality of the vertical radiation groups and the plurality of the horizontal radiation groups are not mixed with each other to prevent radiation interference.

(9) The film antenna according to the above (7), wherein at least one of the plurality of the horizontal radiation patterns may be rotated with respect to another horizontal radiation pattern in a planar view.

(10) The film antenna according to the above (9), wherein the horizontal radiation patterns included in at least one of the plurality of the horizontal radiation groups may be rotated with respect to the horizontal radiation patterns included in another horizontal radiation group in the planar view.

(11) The film antenna according to the above (1) may further include a ground layer formed on the lower surface of the dielectric layer.

(12) The film antenna according to the above (11), wherein the horizontal radiation pattern may not be superimposed over the ground layer in a planar view.

(13) The film antenna according to the above (1) may further include: a first transmission line connected to the vertical radiation pattern; a second transmission line connected to the horizontal radiation pattern; a first pad electrically connected to the vertical radiation pattern via the first transmission line; and a second pad electrically connected to the horizontal radiation pattern via the second transmission line.

(14) The film antenna according to the above (1) may further include a dummy pattern formed around the vertical radiation pattern and the horizontal radiation pattern

(15) The film antenna according to the above (14), wherein the vertical radiation pattern, the horizontal radiation pattern and the dummy pattern may include a mesh pattern structure.

(16) A display device may include the film antenna according to embodiments as described above.

(17) A film antenna may include: a dielectric layer having an upper surface and a lower surface opposite to the upper surface; a vertical radiation pattern on the upper surface of the dielectric layer; and a horizontal radiation pattern on the upper surface of the dielectric layer; a first transmission line connected to the vertical radiation pattern; a second transmission line connected to the horizontal radiation pattern; a first pad electrically connected to the vertical radiation pattern via the first transmission line; and a second pad electrically connected to the horizontal radiation pattern via the second transmission line, wherein the vertical radiation pattern, the horizontal radiation pattern, the first transmission line, the second transmission line, the first pad and the second pad are arranged on the same plane.

(18) The film antenna according to the above (14), wherein the horizontal radiation pattern may include a pair of ground electrodes and a signal electrode of which a part is positioned between the pair of the ground electrodes.

The film antenna according to embodiments of the present invention may include a vertical radiation pattern and a horizontal radiation pattern arranged at the same level or at the same plane. Thus, a dual polarization or a multi-axis signaling may be realized in a single film.

A plurality of the vertical radiation patterns and a plurality of the horizontal radiation patterns may each be arranged to form a group, and the groups may be included in a single film in an array form. Thus, a signal sensitivity may be increased while suppressing a mutual signal interference.

The film antenna may be applied to a display device including a mobile communication device capable of implementing a signal transmittance and reception at high-frequency or ultra-high frequency bands of 3G, 4G, 5G or more so that radiation properties and optical properties such as transmittance may be improved.

DETAILED DESCRIPTION OF THE EMBODIMENTS

According to exemplary embodiments of the present invention, there is provided a film antenna including a vertical radiation pattern and a horizontal radiation pattern arranged at the same level or at the same plane and being capable of implementing a dual polarization or a multi-axis signaling.

The film antenna may be, e.g., a microstrip patch antenna fabricated as a transparent film. The film antenna may be applied to a device for high frequency band or ultra-high frequency band (e.g., 3G, 4G, 5G or more) mobile communications.

According to exemplary embodiments of the present invention, there is provided a display device including the film antenna. However, an application of the film antenna is not limited to the display device, and the film antenna may be applied to various objects or structures such as a vehicle, a home electronic appliance, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
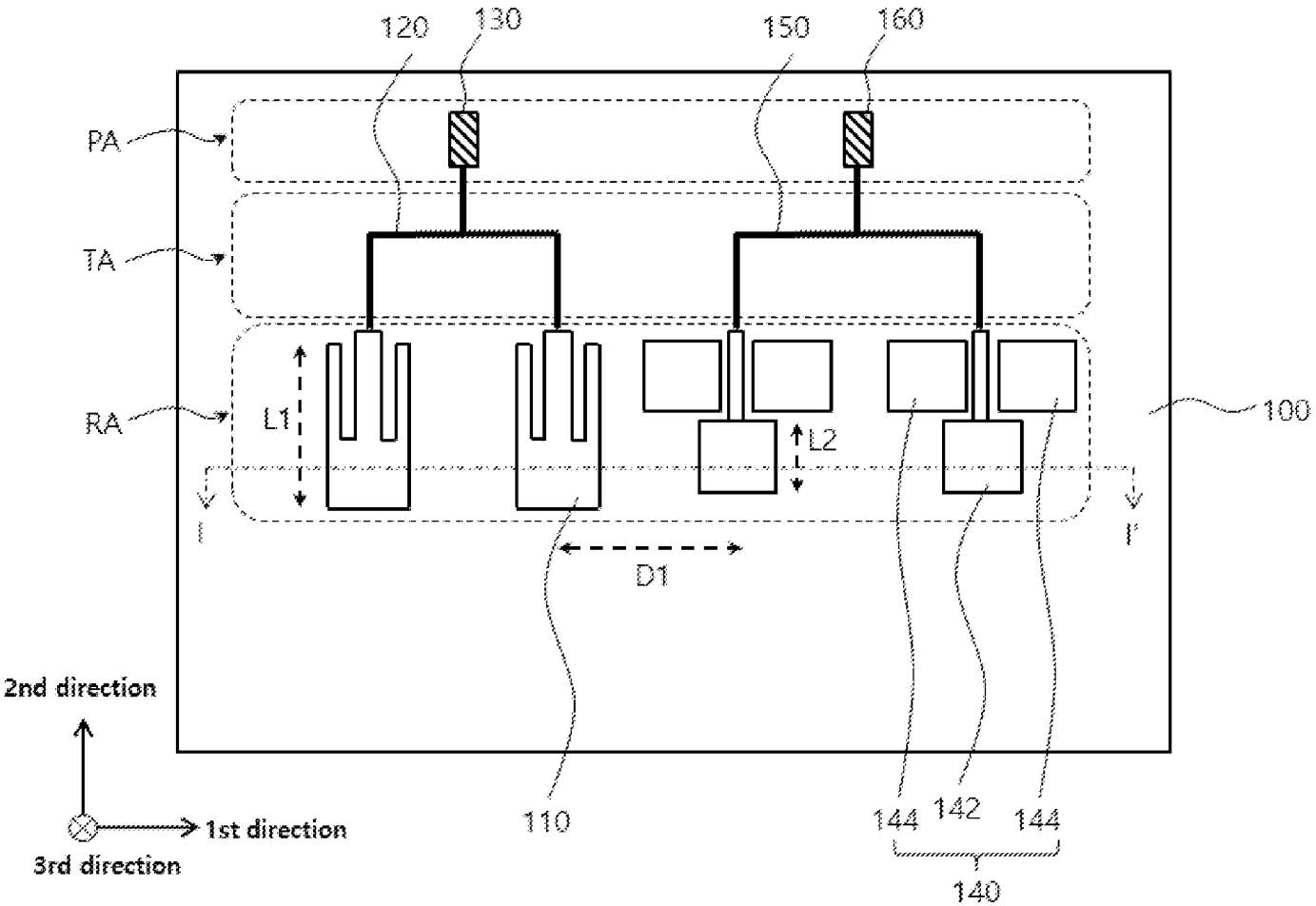
FIG. 1 is a schematic top planar view illustrating a film antenna in accordance with exemplary embodiments.

FIG. 1 is a schematic top planar view illustrating a film antenna in accordance with exemplary embodiments.

In FIG. 1, two directions that are parallel to an upper surface of a dielectric layer 100 and perpendicular to each other are defined as a first direction and a second direction, and a direction vertical to the first and second directions is defined as a third direction. The first, second and third directions may correspond to X-axis, Y-axis, and Z-axis directions, respectively. The definition of the above-described directions may be applied to all accompanying drawings.

Referring to FIG. 1, a film antenna according to exemplary embodiments may include a dielectric layer 100, a vertical radiation pattern 110 and a horizontal radiation pattern 140.

The dielectric layer 100 may include an insulation material having a predetermined dielectric constant. The dielectric layer 100 may include, for example, an inorganic insulation material such as glass, silicon oxide, silicon nitride, a metal oxide, etc., or an organic insulating material such as an epoxy resin, an acrylic resin, an imide-based resin, etc. The dielectric layer 100 may serve as a film substrate of the film antenna on which the radiation patterns 110 and 140 are formed.

For example, the dielectric layer 100 may include a transparent film. The transparent film may include, e.g., a polyester-based resin such as polyethylene terephthalate, polyethylene isophthalate, polyethylene naphthalate, polybutylene terephthalate, etc.; a cellulose-based resin such as diacetyl cellulose, triacetyl cellulose, etc.; a polycarbonate-based resin; an acrylic resin such as polymethyl (meth) acrylate, polyethyl (meth)acrylate, etc.; a styrene-based resin such as polystyrene, an acrylonitrile-styrene copolymer, etc.; a polyolefin-based resin such as polyethylene, polypropylene, a cyclo-based or norbornene-structured polyolefin, an ethylene-propylene copolymer, etc.; a vinyl chloride-based resin; an amide-based resin such as nylon, an aromatic polyamide, etc.; an imide-based resin; a polyether sulfone-based resin; a sulfone-based resin; a polyether ether ketone-based resin; a polyphenylene sulfide-based resin; a vinyl alcohol-based resin; a vinylidene chloride-based resin; a vinyl butyral-based resin; an allylate-based resin; a polyoxymethylene-based resin; an epoxy-based resin; a urethane or acryl urethane-based resin; a silicone-based resin, etc., etc. These may be used alone or a combination thereof.

In some embodiments, an adhesive film including, e.g., a pressure sensitive adhesive (PSA), an optically clear adhesive (OCA), or the like may be included in the dielectric layer 100.

In some embodiments, a dielectric constant of the dielectric layer 100 may be adjusted in a range from about 1.5 to about 12. If the dielectric constant exceeds about 12, a driving frequency may be excessively reduced and an antenna driving in a desired high frequency band may not be obtained.

In exemplary embodiments, the film antenna may include a pad area PA, a transmission area TA, and a radiation area RA. Accordingly, the dielectric layer 100 may also be divided into the pad area PA, the transmission area TA, and the radiation area RA.

The vertical radiation pattern 110 and the horizontal radiation pattern 140 may be arranged together on an upper surface of the dielectric layer 100. According to exemplary embodiments, the vertical radiation pattern 110 and the horizontal radiation pattern 140 may be arranged along the first direction at the same level or at the same layer. For example, the vertical radiation pattern 110 and the horizontal radiation pattern 140 may be arranged on the upper surface of the dielectric layer 100 of the radiation area RA.

As illustrated in FIG. 1, the vertical radiation pattern 110 may include a protrusion connected to a first transmission line 120 at a central portion thereof. However, FIG. 1 illustrates an example of the vertical radiation pattern 110, and a shape of the vertical radiation pattern 110 may be properly modified in consideration of, e.g., radiation efficiency.

A ground layer 90 (see FIG. 2) may be disposed under the vertical radiation pattern 110 and the dielectric layer 100, and thus a signal transmission/reception and a radiation property in the third direction (e.g., the Z-axis direction) may be achieved by the vertical radiation pattern 110.

The horizontal radiation pattern 140 may be disposed adjacent to the vertical radiation pattern 110 in the first direction.

In exemplary embodiments, the horizontal radiation pattern 140 may include a signal electrode 142 and a ground electrode 144. The signal electrode 142 and the ground electrode 144 may be commonly located on the same plane (e.g., on the upper surface of the dielectric layer 100).

The horizontal radiation pattern 140 may be formed to implement a monopole and/or dipole antenna. In some embodiments, as illustrated in FIG. 1, one horizontal radiation pattern 140 may include two ground electrodes 144 and one signal electrode 142. For example, the signal electrode 142 may include a protrusion or an extension that may be inserted between a pair of the ground electrodes 144.

The ground electrodes 144 and the signal electrodes 142 may be disposed to be adjacent to each other on the same plane, signal transmission/reception or radiation properties in a plane including the first direction and the second direction may be implemented by the horizontal radiation pattern 140.

The signal electrode 142 and the ground electrode 144 may each be patterned in a polygonal shape such as a square shape. However, the shape of the signal electrode 142 and the ground electrode 144 may be appropriately changed in consideration of radiation efficiency and spatial efficiency.

The vertical radiation pattern 110 and the horizontal radiation pattern 140 may each include silver (Ag), gold (Au), copper (Cu), aluminum (Al), platinum (Pt), palladium (Pd), chrome (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy thereof. These may be used alone or in combination thereof.

For example, the vertical radiation pattern 110 and the horizontal radiation pattern 140 may include silver (Ag) or a silver alloy such as a silver-palladium-copper (APC) alloy to implement a low resistance.

In an embodiment, the vertical radiation pattern 110 and the horizontal radiation pattern 140 may include copper (Cu) or a copper alloy in consideration of low resistance and pattern formation with a fine line width. For example, the vertical radiation pattern 110 and the horizontal radiation pattern 140 may include a copper-calcium (Cu—Ca) alloy.

In some embodiments, the vertical radiation pattern 110 and the horizontal radiation pattern 140 may include a transparent metal oxide such as indium tin oxide (ITO), indium zinc oxide (IZO), indium zinc tin oxide (ITZO), zinc oxide (ZnOx), etc.

For example, the vertical radiation pattern 110 and the horizontal radiation pattern 140 may have a multi-layered structure including a metal layer or alloy layer and a transparent metal oxide layer.

In some embodiments, the vertical radiation pattern 110 and the horizontal radiation pattern 140 may include a mesh-pattern structure to improve transmittance.

In some embodiments, the vertical radiation pattern 110 and the horizontal radiation pattern 140 may have a high transmittance thin metal film structure. For example, the vertical radiation pattern 110 and the horizontal radiation pattern 140 may have a solid metal thin film structure of a thickness in a range from about 50 Å to about 200 Å. For example, a transmittance of the vertical radiation pattern 110 and the horizontal radiation pattern 140 may be about 70% or more, preferably about 80% or more.

A distance between a center of the vertical radiation pattern 110 and a center of the horizontal radiation pattern 140 neighboring each other (a first distance D1) may be $\lambda/2$ or more. In the above range, radiation interference between the vertical radiation pattern 110 and the horizontal radiation pattern 140 may be suppressed. The term "$\lambda$" used herein may refer to a wavelength corresponding to a frequency band capable of being sensed by the film antenna. In an embodiment, the first distance D1 may be $\lambda$ or more.

For example, the first distance D1 may be defined as a horizontal distance (a distance in the first direction) between the center of the vertical radiation pattern 110 and the center of the signal electrode 142 which are adjacent to face each other.

Lengths (lengths in the second direction) of the vertical radiation pattern 110 and the horizontal radiation pattern 140 may be adjusted in consideration of resonance frequency and signal sensitivity.

In some embodiments, a length L1 of the vertical radiation pattern 110 may be $\lambda/2$ or more, for example, may be in a range from about 0.5 mm to 10 cm in a 5G frequency operation.

In the horizontal radiation pattern 140, a length L2 of the signal electrode 142 and the ground electrode 144 may each be $\lambda/4$ or more, and may be $\lambda/2$ or more in an embodiment. For example, in the 5G frequency operation, the length L2 of the signal electrode 142 and the ground electrode 144 may each be in a range from about 0.25 mm to 10 cm.

As described above, the vertical radiation pattern 110 and the horizontal radiation pattern 140 may be arranged together in a single level or in a single layer of the film antenna, so that multi-axis orientation or double polarization properties may be implemented in a single film or patch. Accordingly, a signal loss caused by a high-frequency band communication may be reduced, and a signal sensitivity and a signal efficiency may be also improved.

Additionally, a gain property of the film antenna may be improved through a combination of the vertical radiation pattern 110 and the horizontal radiation pattern 140. For example, the film antenna according to exemplary embodiments may provide a gain of 7 dBi or more.

Transmission lines 120 and 150 may be disposed on a portion of the dielectric layer 100 of the transmission area TA to be connected to the radiation patterns 110 and 140. In exemplary embodiments, a first transmission line 120 and a second transmission line 150 may be connected to the vertical radiation pattern 110 and the horizontal radiation pattern 140, respectively. For example, one end portions of the transmission lines 120 and 150 may be connected to each of the radiation patterns 110 and 140.

The transmission lines 120 and 150 may include a conductive material substantially the same as that of the radiation patterns 110 and 140, and may be formed together with the radiation patterns 110 and 140 by the same etching process. In exemplary embodiments, the transmission lines 120 and 150 and the radiation patterns 110 and 140 may be formed on the upper surface of the dielectric layer 100 to form a conductive layer at the same level.

The transmission lines 120 and 150 may extend the pad area PA to be electrically connected to pads 130 and 160. For example, the first transmission line 120 may extend from a first pad 130 and may be branched to be connected to a plurality of the vertical radiation patterns 110. Further, the second transmission line 150 may extend from a second pad 160 and may be branched to be connected to a plurality of the horizontal radiation patterns 140.

In some embodiments, the pads 130 and 160 may be disposed at the same layer or at the same plane as those of the transmission lines 120 and 150 and the radiation patterns 110 and 140. In some embodiments, the pads 130 and 160 may be formed at an upper level from the transmission lines 120 and 150. For example, an insulation layer (not illustrated) covering the transmission lines 120 and 150 may be formed on the dielectric layer 100, and the pads 130 and 160 may be formed on the insulation layer. For example, the pads 130 and 160 may be electrically connected to the transmission lines 120 and 150 through vias or contacts penetrating the insulation layer.

In the film antenna or the dielectric layer 100, a region except for the pad region PA, the transmission region TA, and the radiation region RA may be defined as a dummy region.

In some embodiments, at least a portion of the dummy region may be filled with a dummy pattern including a mesh pattern structure. In some embodiments, the radiation patterns 110 and 140 may also include a mesh pattern structure, and a remaining region of the radiation area RA except the region where the radiation patterns 110 and 140 are formed may be also substantially filled with the dummy pattern.

In some embodiments, remaining regions of the pad area PA and the transmission area TA except the region where the pads 130 and 160 and the transmission lines 120 and 150 are formed may be also substantially filled with the dummy pattern.

A visual recognition of the radiation patterns 110 and 140 by a user due to an optical deviation may be prevented or reduced by the dummy pattern.

Figure 2:
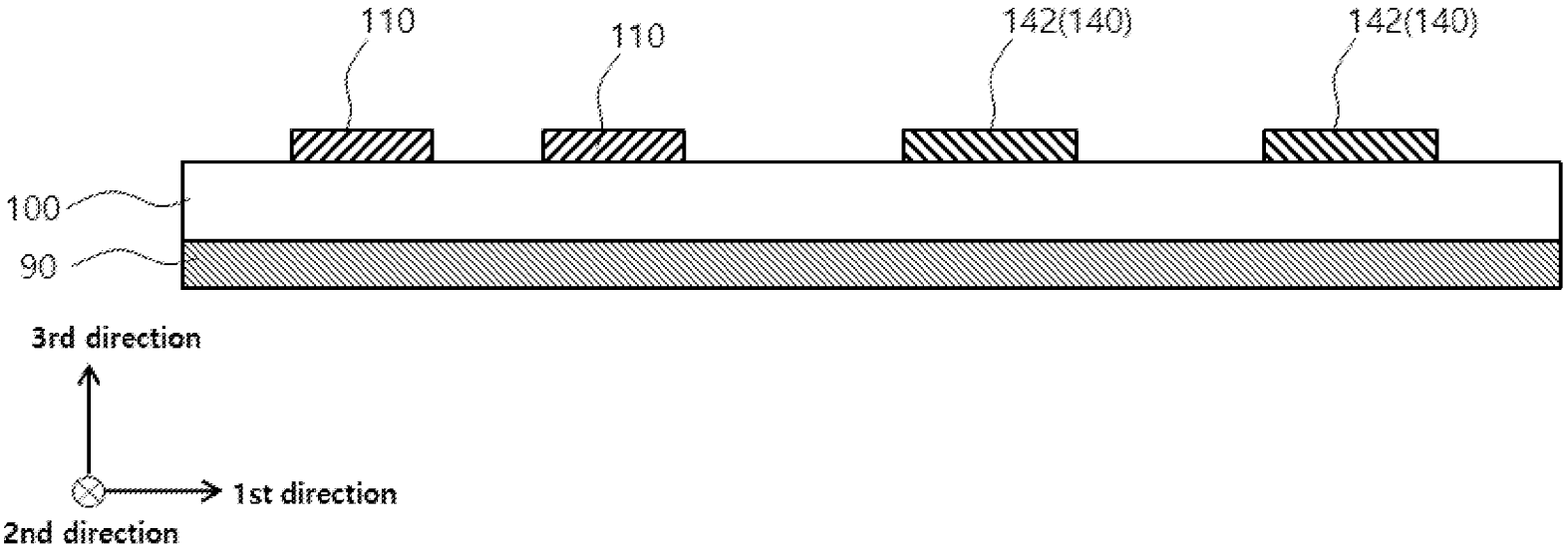
FIGS. 2 and 3 are schematic cross-sectional views illustrating film antennas in accordance with exemplary embodiments.
Figure 3:
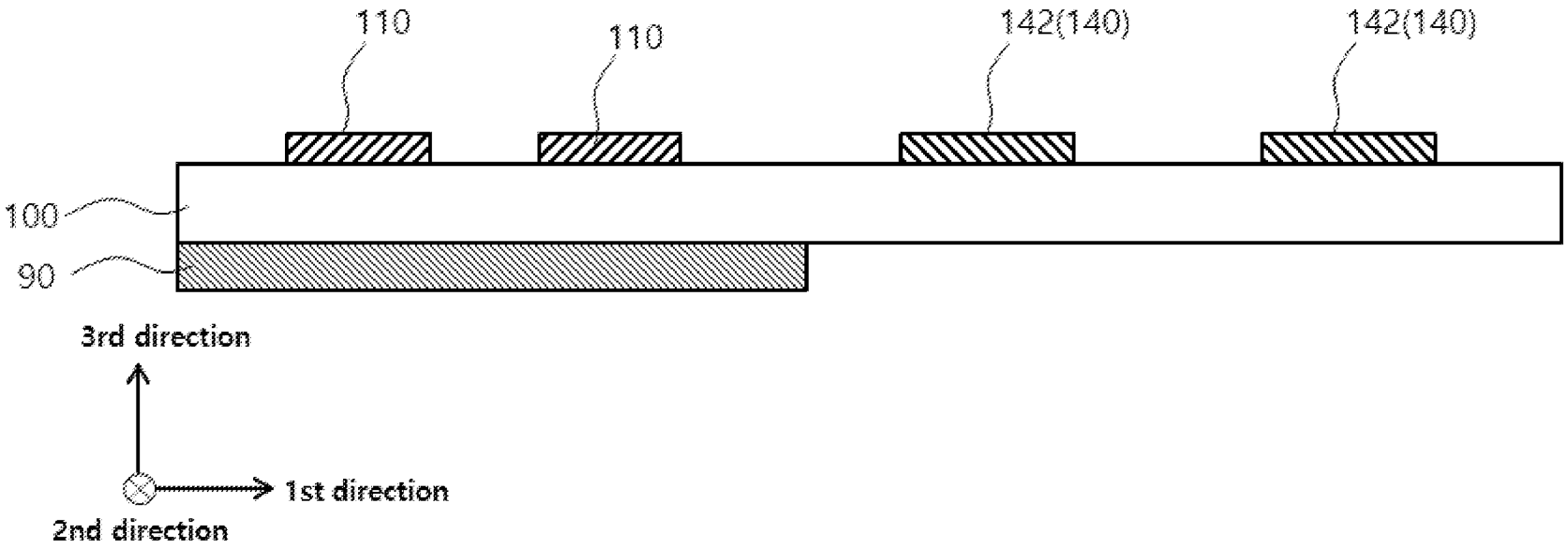

FIGS. 2 and 3 are schematic cross-sectional views illustrating film antennas in accordance with exemplary embodiments. Specifically, FIGS. 2 and 3 are cross-sectional views taken along a line I-I' of FIG. 1.

Referring to FIG. 2, a ground layer 90 may be formed on a lower surface of the dielectric layer 100. The ground layer 90 may include a conductive material such as a metal, an alloy, a transparent metal oxide, etc.

The ground layer 90 may serve as a ground electrode overlapping the vertical radiation pattern 110 to create a vertical polarization.

In some embodiments, a connecting ground layer (not illustrated) connecting the ground layer 90 and the first pad 130 with each other may be formed.

In some embodiments, the ground layer 90 may be included as an individual element of the film antenna. In some embodiments, a conductive member of a display device to which the film antenna is applied may serve as a ground layer.

The conductive member may include, e.g., a gate electrode of a thin film transistor (TFT), various wires such as a scan line or a data line, or various electrodes such as a pixel electrode and a common electrode included in a display panel.

Referring to FIG. 3, the ground layer 90 may selectively overlap the vertical radiation pattern 110. In this case, the ground layer 90 may not overlap the horizontal radiation pattern 140. For example, the ground layer 90 may be patterned to be removed in an area overlapping the horizontal radiation pattern 140.

The ground layer 90 may selectively overlap the vertical radiation pattern 110, so that a radiation interference with the horizontal radiation pattern 140 may be additionally blocked.

Figure 4:
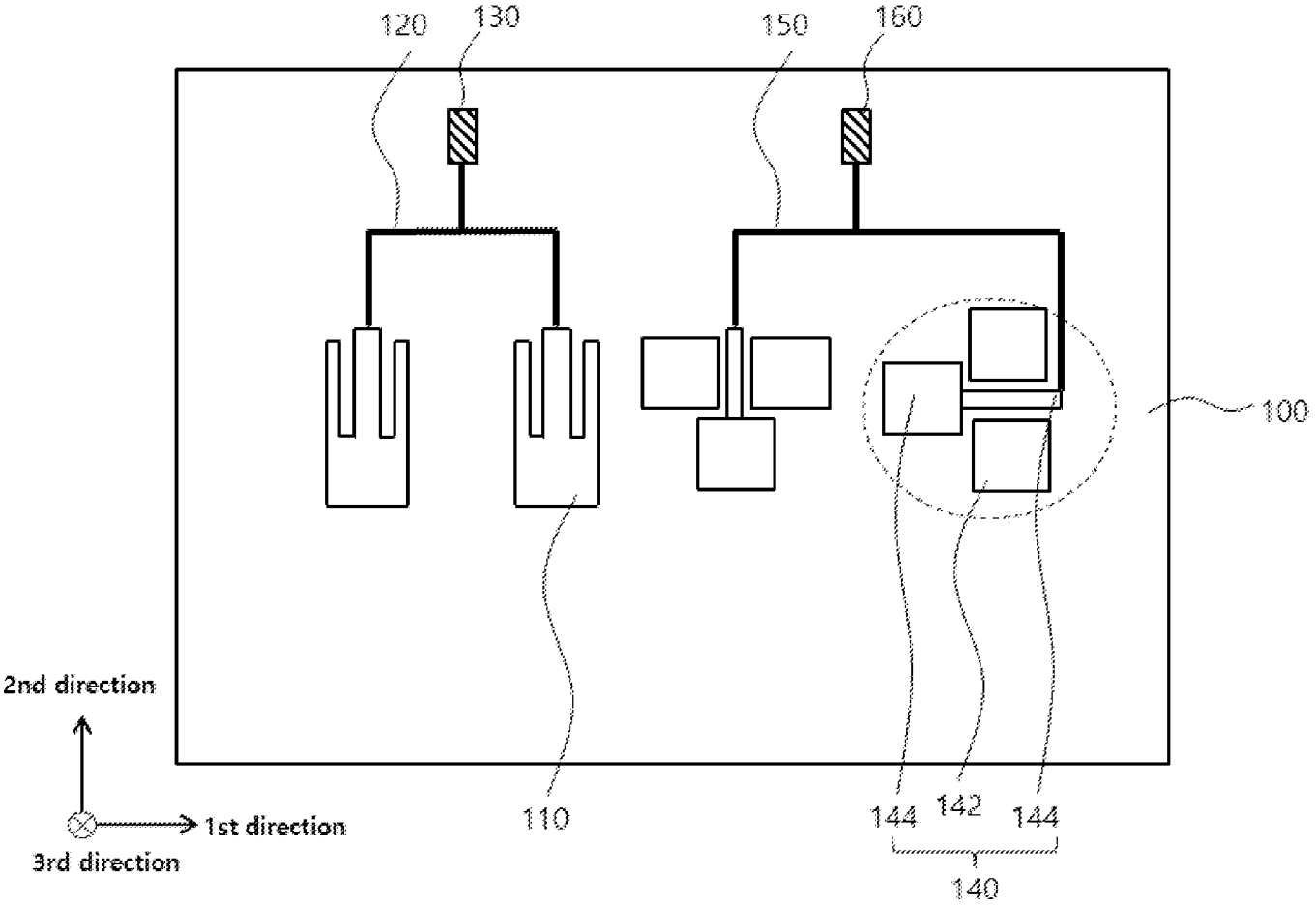
FIG. 4 is a schematic top planar view illustrating a film antenna in accordance with some exemplary embodiments.

FIG. 4 is a schematic top planar view illustrating a film antenna in accordance with some exemplary embodiments.

Referring to FIG. 4, the film antenna includes a plurality of the horizontal radiation patterns 140, and at least one of the horizontal radiation patterns 140 may be rotated in a planar view with respect to other horizontal radiation patterns 140.

For example, as illustrated in FIG. 4, the horizontal radiation pattern 140 indicated by a dotted circle may be rotated 90 degrees)(° in a clockwise direction with respect to another adjacent horizontal radiation pattern 140.

However, the rotation angle is not necessarily limited to 90°, and may be any angle greater than 0°. Further, the rotation angle may be defined in a clockwise or counterclockwise direction.

At least one horizontal radiation pattern 140 may be rotated so that a radiation coverage on the plane defined by the first and second directions may be expanded to enhance the signaling efficiency and sensitivity.

Figure 5:
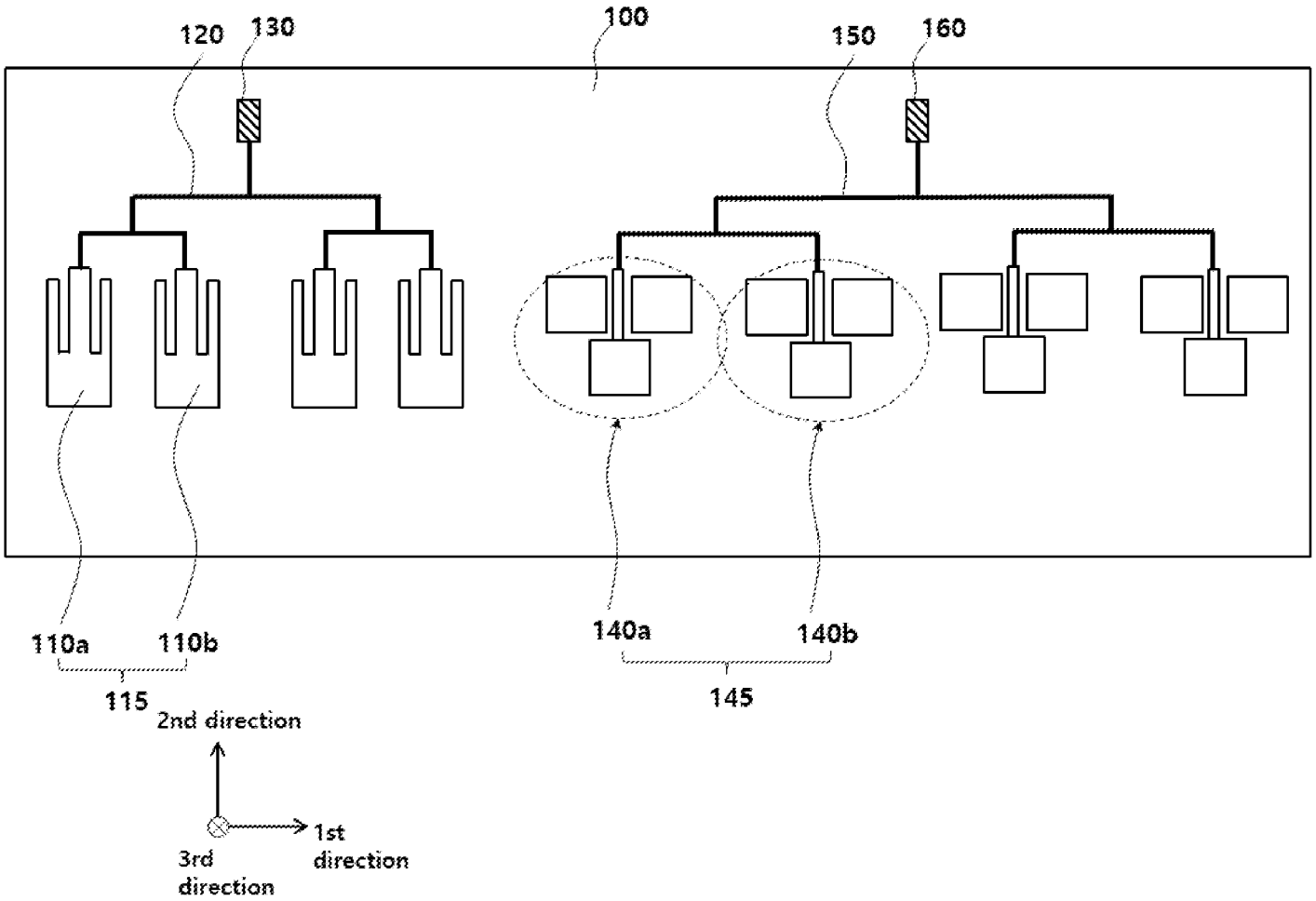
FIG. 5 is a schematic top planar view illustrating a film antenna in accordance with some exemplary embodiments.

FIG. 5 is a schematic top planar view illustrating a film antenna in accordance with some example embodiments.

Referring to FIG. 5, the film antenna may include a plurality of the vertical radiation patterns 110 and a plurality of the horizontal radiation patterns 145.

In exemplary embodiments, a predetermined number of the vertical radiation patterns 110 may define one vertical radiation group 115. For example, a first vertical radiation pattern **110*a* and a second vertical radiation pattern 110*b* may form one vertical radiation group 115, and a plurality of the vertical radiation groups 115** may be arranged along the first direction.

A predetermined number of the horizontal radiation patterns 140 may define one horizontal radiation group 145. For example, a first horizontal radiation pattern **140*a* and a second horizontal radiation pattern 140*b* may form one horizontal radiation group 145, and a plurality of the horizontal radiation groups 145** may be arranged along the first direction.

The vertical radiation group 115 and the horizontal radiation group 145 may be alternately arranged or may be separated while not being mixed with each other to prevent radiation interference. For example, a plurality of the vertical radiation groups 115 may be successively arranged, and a plurality of the horizontal radiation groups 145 may be successively arranged.

As described above, the distance between a center of the vertical radiation pattern 110 and a center of the horizontal radiation pattern 140 adjacent to each other may be λ/2 or more, and in an embodiment, may be λ or more.

The first pad 130 may be commonly connected to a plurality of the vertical radiation groups 115 via the first transmission line 120. For example, as illustrated in FIG. 5, the vertical radiation group 115 may be defined by two vertical radiation patterns 110 (1*2 arrangement), and two vertical radiation groups 115 may be merged by one first pad 130 (e.g., 1*4 arrangement).

The second pad 160 may also be commonly connected to a plurality of horizontal radiation groups 145 via the second transmission line 150. For example, as illustrated in FIG. 5, the horizontal radiation group 145 may be defined by two horizontal radiation patterns 140 (1*2 arrangement), and two horizontal radiation groups 145 may be merged by one second pad 160 (e.g., 1*4 arrangement).

As described above, an array may be formed by grouping the vertical radiation patterns 110 and horizontal radiation patterns 140 so that a density of the radiation patterns may be increased and an efficiency of signal transmission and reception may be further improved.

Additionally, as described with reference to FIG. 4, at least one horizontal radiation pattern 145 may be rotated with respect to another horizontal radiation pattern in a planar view.

In some embodiments, the horizontal radiation patterns 145 included in at least one horizontal radiation group 145 may be rotated as illustrated in FIG. 4.

Figure 6:
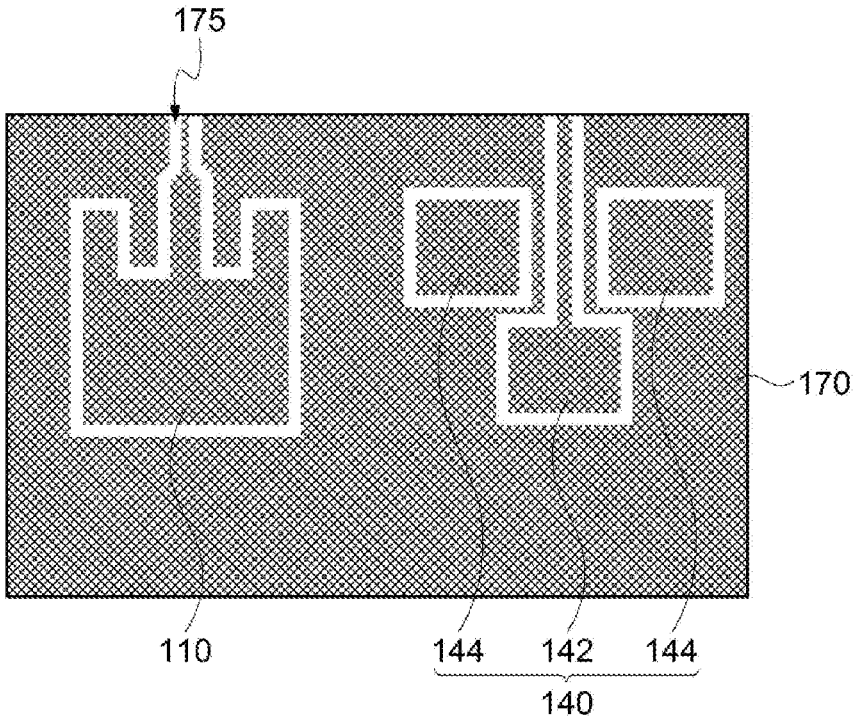
FIG. 6 is a schematic top planar view illustrating a pattern structure of a film antenna in accordance with some exemplary embodiments.

FIG. 6 is a schematic top planar view illustrating a pattern structure of a film antenna in accordance with some exemplary embodiments.

Referring to FIG. 6, as described above, a dummy pattern 170 having a mesh pattern structure may be formed around the radiation patterns 110 and 140. The radiation patterns 110 and 140 may include a mesh pattern structure substantially the same as or similar to that of the dummy pattern 170.

In exemplary embodiments, the radiation patterns 110 and 140 and the dummy pattern 170 may be separated and insulated from each other by a separation region 175 formed along boundaries of the radiation patterns 110 and 140.

The radiation patterns 110 and 140 and the dummy pattern 170 may be formed of substantially the same or similar mesh pattern structure so that the radiation patterns 110 and 140 may be prevented from being visually recognized due to a pattern shape deviation while improving a transmittance of the film antenna.

Figure 7:
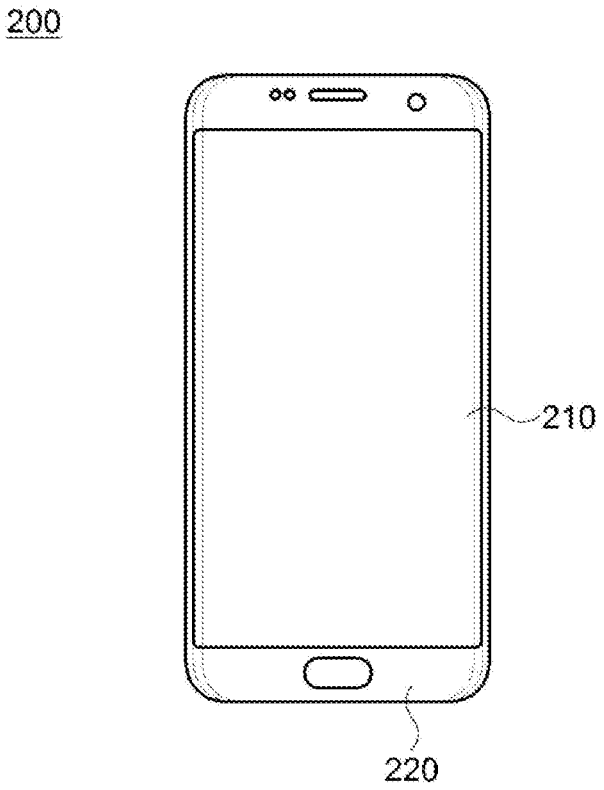
FIG. 7 is a schematic top planar view illustrating a display device in accordance with exemplary embodiments.

FIG. 7 is a schematic top planar view illustrating a display device in accordance with exemplary embodiments. For example, FIG. 7 illustrates an outer shape including a window of a display device.

Referring to FIG. 7, a display device 200 may include a display region 210 and a peripheral region 220. The peripheral region 220 may be positioned, e.g., at both lateral portions and/or both end portions.

In some embodiments, the above-described film antenna may be inserted in the display device 200 as a patch shape. In some embodiments, the radiation area RA of the film antenna as described with reference to FIG. 1 may be disposed to at least partially correspond to the display region 210 of the display device 200, and the pad area PA may be disposed to correspond to the peripheral region 220 of the display device 200.

The peripheral region 220 may correspond to, e.g., a light-shielding portion or a bezel portion of the display device 200. Additionally, a driving circuit such as an IC chip of the display device 200 and/or the film antenna may be disposed in the peripheral region 220.

The pad region PA of the film antenna may be disposed to be adjacent to the driving circuit so that a length of a signaling path may be decreased to suppress a signal loss.

What is claimed is:

1. A film antenna, comprising:

a dielectric layer having an upper surface and a lower surface opposite to the upper surface;

a vertical radiation pattern on the upper surface of the dielectric layer; and a horizontal radiation pattern on the upper surface of the dielectric layer, the vertical radiation pattern and the horizontal radiation pattern being arranged on the same plane, wherein a distance between a center of the vertical radiation pattern and a center of the horizontal radiation pattern adjacent to each other is λ/2 or more.

2. The film antenna according to claim 1, wherein a length of the vertical radiation pattern is λ/2 or more.

3. The film antenna according to claim 1, wherein the horizontal radiation pattern comprises a signal electrode and a ground electrode disposed on the same plane.

4. The film antenna according to claim 3, wherein the ground electrode comprises a pair of the ground electrodes, and a portion of the signal electrode extends between the pair of the ground electrodes.

5. The film antenna according to claim 3, wherein a length of the signal electrode is λ/4 or more.

6. The film antenna according to claim 1, wherein the vertical radiation pattern comprises a plurality of the vertical radiation patterns, and the horizontal radiation pattern comprises a plurality of the horizontal radiation patterns; and the plurality of the vertical radiation patterns comprise a plurality of vertical radiation groups each formed by a predetermined number of the vertical radiation patterns, and the plurality of the horizontal radiation patterns comprise a plurality of horizontal radiation groups each formed by a predetermined number of the horizontal radiation patterns.

7. The film antenna according to claim 6, wherein the plurality of the vertical radiation groups are successively arranged, and the plurality of the horizontal radiation groups are successively arranged, while the plurality of the vertical radiation groups and the plurality of the horizontal radiation groups are not mixed with each other to prevent radiation interference.

8. The film antenna according to claim 6, wherein at least one of the plurality of the horizontal radiation patterns is rotated with respect to another horizontal radiation pattern in a planar view.

9. The film antenna according to claim 8, wherein the horizontal radiation patterns included in at least one of the plurality of the horizontal radiation groups are rotated with respect to the horizontal radiation patterns included in another horizontal radiation group in the planar view.

10. The film antenna according to claim 1, further comprising a ground layer formed on the lower surface of the dielectric layer.

11. The film antenna according to claim 10, wherein the horizontal radiation pattern is not superimposed over the ground layer in a planar view.

12. The film antenna according to claim 1, further comprising:

a first transmission line connected to the vertical radiation pattern;

a second transmission line connected to the horizontal radiation pattern;

a first pad electrically connected to the vertical radiation pattern via the first transmission line; and a second pad electrically connected to the horizontal radiation pattern via the second transmission line.

13. The film antenna according to claim 1, further comprising a dummy pattern formed around the vertical radiation pattern and the horizontal radiation pattern.

14. The film antenna according to claim 13, wherein the vertical radiation pattern, the horizontal radiation pattern and the dummy pattern include a mesh pattern structure.

15. A display device comprising the film antenna according to claim 1.

16. A film antenna, comprising:

a dielectric layer having an upper surface and a lower surface opposite to the upper surface;

a vertical radiation pattern on the upper surface of the dielectric layer; and a horizontal radiation pattern on the upper surface of the dielectric layer;

a first transmission line connected to the vertical radiation pattern;

a second transmission line connected to the horizontal radiation pattern;

a first pad electrically connected to the vertical radiation pattern via the first transmission line; and a second pad electrically connected to the horizontal radiation pattern via the second transmission line, wherein the vertical radiation pattern, the horizontal radiation pattern, the first transmission line, the second transmission line, the first pad and the second pad are arranged on the same plane.

17. The film antenna of claim 16, wherein the horizontal radiation pattern comprises a pair of ground electrodes and a signal electrode of which a part is positioned between the pair of the ground electrodes.

* * * * *